United States Patent [19]

Fotland et al.

[11] Patent Number: 4,777,106

[45] Date of Patent: Oct. 11, 1988

[54] ELECTROSTATIC TONING

[75] Inventors: Richard A. Fotland, Holliston; Leo A. Beaudet, Milford, both of Mass.

[73] Assignee: Dennison Manufacturing Company, Framingham, Mass.

[21] Appl. No.: 18,306

[22] Filed: Feb. 24, 1987

[51] Int. Cl.[4] ..... G03G 15/08

[52] U.S. Cl. ..... 430/120; 118/654; 118/DIG. 5

[58] Field of Search ..... 118/654, DIG. 5; 430/120; 427/14.1

[56] References Cited

U.S. PATENT DOCUMENTS 4,088,093 5/1978 Pan ..... 118/630

4,124,287 11/1978 Beau et al. ..... 118/657 X

*Primary Examiner*—Evan K. Lawrence

*Attorney, Agent, or Firm*—George E. Kersey

[57] ABSTRACT

An electrostatic toning system employed in applying toner to latent electrostatic images on the surface of a dielectric material. Toning is accomplished by fluidizing the toner in a gaseous stream, charging the toner in the fluidized bed, and conveying the charged toner to the dielectric surface by means of a toner receptive member in contact with the fluidized toner.

8 Claims, 4 Drawing Sheets

ELECTROSTATIC TONING

BACKGROUND OF THE INVENTION

The invention relates to a method and apparatus for the delivery of toner from a reservoir to a member carrying an electrostatic pattern to be toned before transfer to a receptor such as paper.

Toner in particulate form is normally supplied under gravity from an opening in the bottom of a hopper and transported from this opening to the point of transfer onto a charged member. A metering roll is typically used to measure selected amounts of toner from the hopper. It then transfers toner onto an applicator roll which then applies the toner to an electrostatic charge pattern defining the image to be printed. The problems associated with such systems have included the formation of lumps of toner at the bottom of the hopper and bridging across the bottom opening. Single component toners used in electrostatic printing tend to aggregate under pressure when stored in amounts sufficient to permit the printer to operate for an adequate period of time. This lumping and/or bridging results in an uneven distribution of toner and may interrupt printing entirely.

Toners commonly employed in electrographic printing are held on the surface of the applicator roll through magnetic forces. Iron oxide is incorporated into the toner formulation to obtain the magnetic properties required. This results in a toner that is expensive, dense and abrasive. Conductive toners are also used in printing. These toners contain carbon to provide suitable conductivity. However conductive toners can limit printing quality when colored toners are utilized.

In view of these considerations a system to provide a steady, evenly distributed flow of toner to the surface of a dielectric member is described.

Accordingly, it is an object of the invention to provide a system for delivering toner to a charged dielectric member. A related object is to provide an efficient and continuous delivery system for toner resulting in a printed image of desired quality upon transfer to paper. A further related object is to permit the use of non-magnetic, non-conductive toners.

SUMMARY OF THE INVENTION

In accomplishing the foregoing and related objects the invention provides a method and apparatus for applying toner to an electrostatic latent image. The method utilizes a toner reservoir in which toner particles are fluidized and charged forming a cloud above the bed of toner contained in the reservoir. The cloud of charged particles then coats a toner applicator roll which effects the transfer of toner to a latent electrostatic image.

In a preferred embodiment charged particle migration into the cloud is facilitated by the use of a fluidized bed generated by using a gaseous stream, preferably air, fed through a grate in the reservoir and up through the toner. The solid toner particles are suspended in this stream of air causing them to flow like a fluid. Once a toner particle becomes charged within the bed it is repelled by similarly charged particles. The electric field generated by these charged particles is sufficient to generate a cloud of charged particles above the fluidized bed of toner. This cloud is attracted to a suitably grounded or biased member whose surface becomes coated with the charged toner. The biased member is preferably a metal applicating cylinder which rotates the coated toner to a position opposite a dielectric cylinder or belt which has been selectively charged electrostatically by an ion generating printhead in the form of latent images to be printed. The dielectric cylinder or belt is suitably charged and biased so that the toner is transferred to its surface in the shape of the electrostatically defined images. Biasing of the dielectric cylinder may be used to prevent unwanted background toning. These toned images are subsequently transferred to a printable substrate such as paper.

In a preferred embodiment of the invention the toner particles are charged within the reservoir by a high voltage corona discharge system. A corona wire or a set of corona discharge points are operated at a voltage of about 7000 volts. When a non-magnetic, non-conductive toner is exposed to this type of discharge voltage the individual particles will become charged with the same polarity and in sufficient density to support the charged cloud.

The reservoir may be vibrated to enhance the even distribution and charging of toner. Both the vibration and the air flow serve to facilitate suitable cloud formation and coating of the applicating cylinder by aiding the easy migration of charged particles through the fluidized toner into the cloud.

It is desirable to reduce the presence of oppositely charged particles within the cloud as well as particles that are introduced into the cloud as a result of the air flow. The preferred embodiment of the invention utilizes materials that reduce or eliminate the presence of negatively charged particles, for example, in a positively charged cloud. The air flow mechanism is designed to suppress the lifting of lighter chargeless toner particles into the cloud which will tend to reduce the transfer efficiency of the toning mechanism.

DETAILED DESCRIPTION

Figure 1:
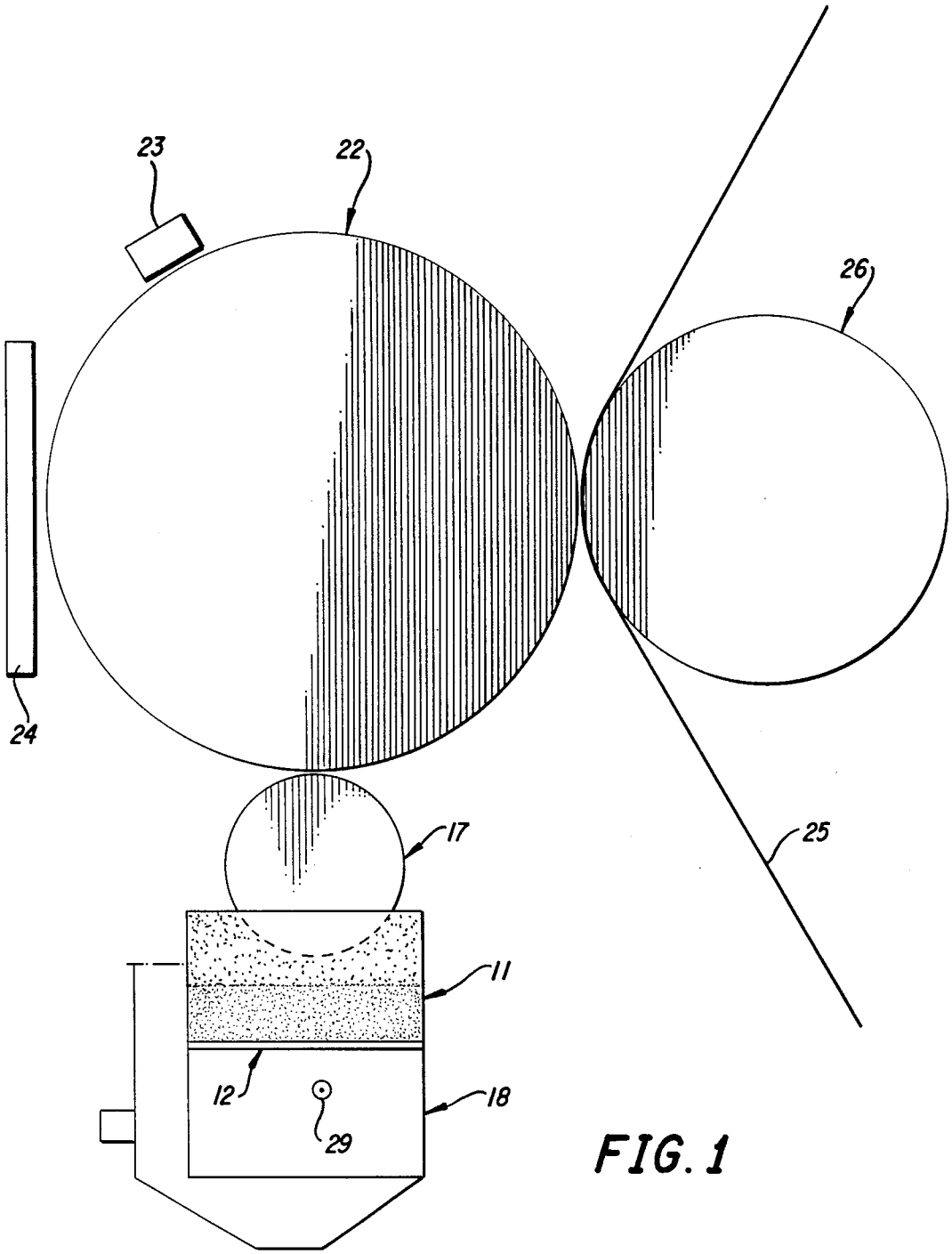
FIG. 1 is a schematic view showing the fluidized bed apparatus in conjunction with the electrostatic printer.

Reference should be had to FIGS. 1–5 for a detailed description of the invention. The components used to achieve electrostatic printing are illustrated in the schematic view of FIG. 1 in which an ion generating printhead 24 imparts electrostatic images onto the surface of a dielectric cylinder 22. The image is then toned, in this example by an applicating cylinder 17. The toned image is then transferred to a toner receptive substrate 25 such as paper. Any residual charge on the dielectric cylinder after toner transfer is removed electrically by an eraser 23 before that point on the dielectric cylinder is charged with further electrostatic images. This schematic and the example below are illustrative and should not be construed as the only method of transfering toner to paper in accordance with the invention. For example, the applicating roll 17 might be removed from the system permitting direct toner transfer to the dielectric cylinder 22.

Figure 2:
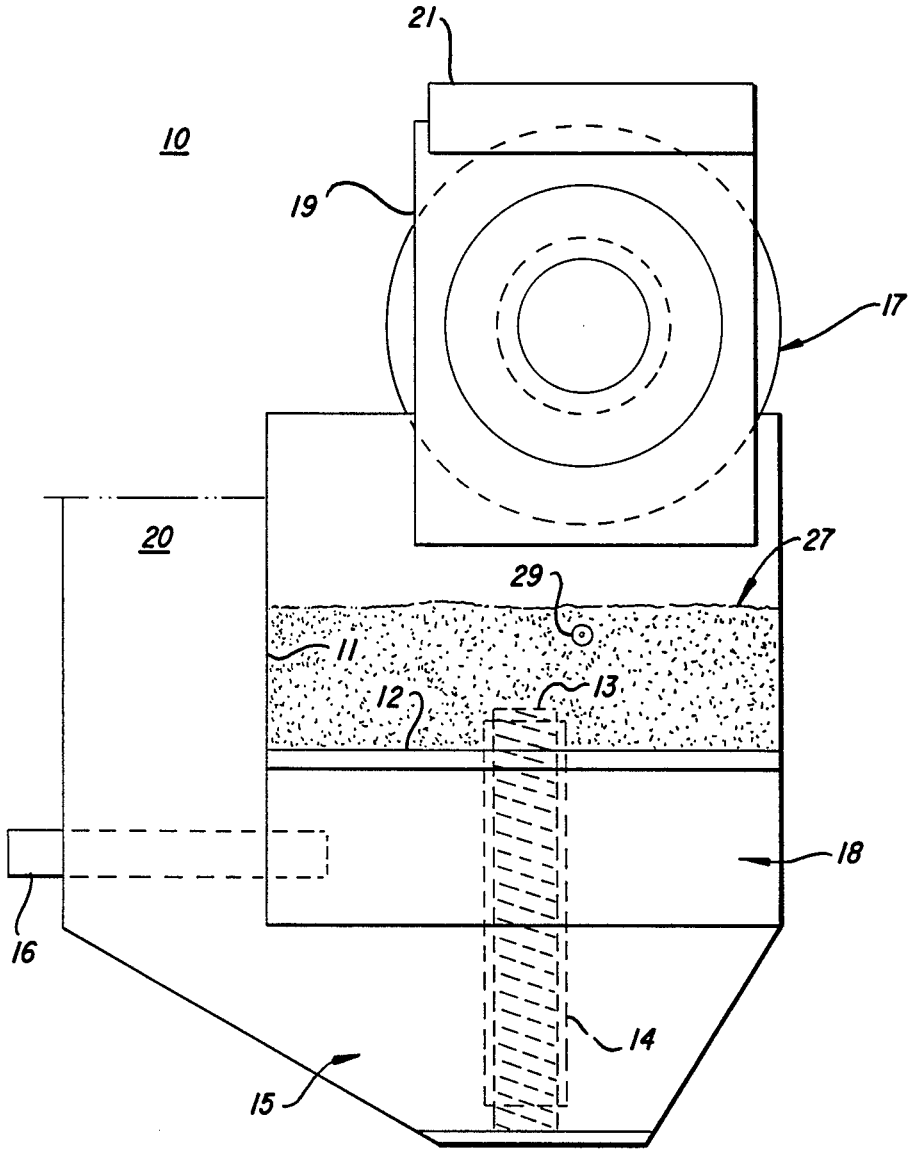
FIG. 2 is a sectional view of the fluidized bed apparatus with the applicating cylinder.

This high speed toning system provides an efficient and dependable method for applying toner to the surface of the dielectric cylinder so that excellent print quality is maintained. The invention illustrated in FIG. 2 shows an apparatus 10 for applying toner to the surface of the dielectric cylinder 22. Toner is fed through the channel 20 into a storage bin 15 where means, in this case a screw 13 in housing 14, is used to introduce toner into a reservoir 11. The toner rests on a porous grate 12 until a gas is fed through the pores of the grate 12 at a rate sufficient to suspend the solid toner particles as a fluidized bed. That is, a gas, preferably air, is used to float the toner particles in such a way that they flow like a fluid within the reservoir. In the preferred embodiment the pores of the grate 12 are sufficiently fine and evenly spaced to generate a smooth and evenly distributed mass of toner particles supported above the grate by the air flow. A pore size of about 5 microns has been used however this may be varied depending upon the toner particle size and the desired characteristics of the air flow. Even air flow is desirable to insure even height of the fluidized bed across the reservoir. If the bed is uneven this may result in an uneven coating of toner on the applicator surface 17. An air chamber 18 supplied by a pressurized source 16 is maintained at a constant pressure to insure a steady flow.

A steel applicator roll 17 is supported by a frame 19 with the gap between the roll 17 and the dielectric cylinder 22 controlled by the carrier 21.

Figure 3:
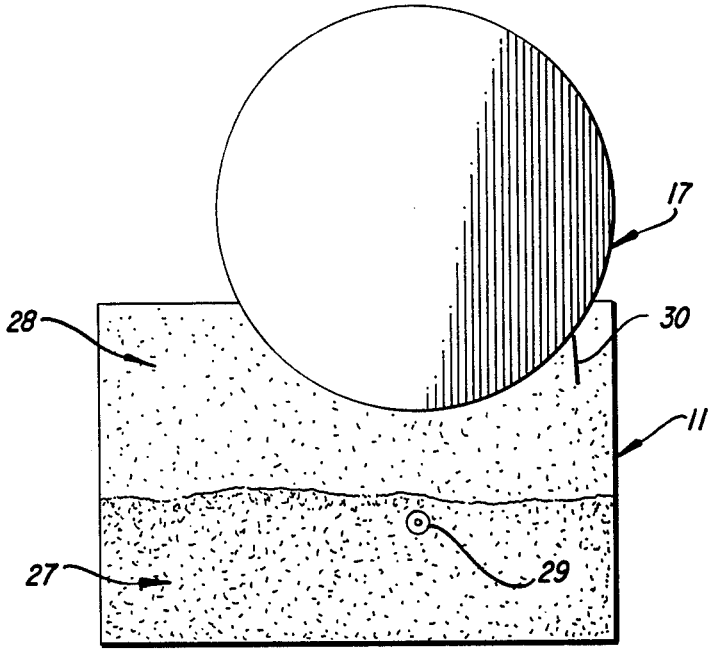
FIG. 3 is a sectional view of the fluidized bed and the cloud generated above by a corona wire.
Figure 5:
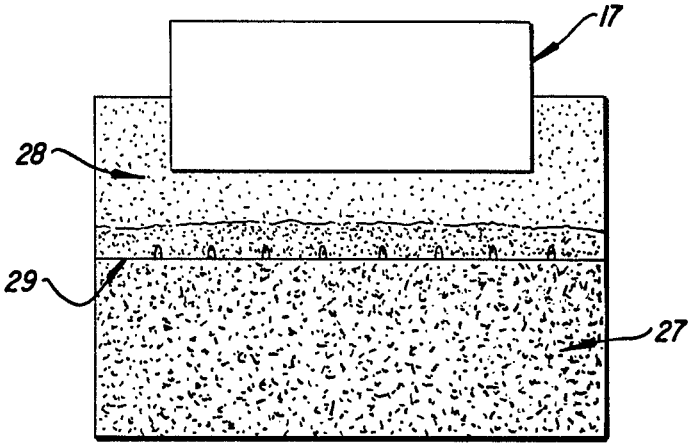
FIG. 5 is a sectional view illustrating the use of corona point discharges.

Once the toner is fluidized a corona discharge in the form of a wire, or a set of corona points as shown if FIG. 5, may be used to electrostatically charge the toner within the fluidized bed. A positive corona voltage, typically on the order of 7000 volts, may be used to generate positively charged toner particles that repel one another. The corona discharge 29 may be positioned below the fluidized bed in the air flow, as shown in FIG. 1, so that the air used to generate the fluidized bed charges the toner. Alternatively, the corona discharge may be placed within the fluidized bed of toner as illustrated in FIG. 2. FIG. 3 illustrates the use of a scraper blade to remove residual toner on the applicator roll so as to avoid any buildup of toner on the applicator surface. Such a buildup could cause uneven toning of latent images on the dielectric surface.

A sufficient number of positively charged particles generates an electric field which results in the migration of charged toner particles into a space above the fluidized bed. This cloud of charged toner particles thereby comes into contact with the applicator roll 17 located above the fluidized bed. When grounded or provided with a suitable bias voltage, the applicator roll becomes coated with a layer of charged toner particles. This layer is then rotated to a position opposite the dielectric cylinder 22.

The ion generator 24 generates electrostatic images on the surface of the dielectric cylinder 22 which are to be printed on paper. When these electrostatic images are rotated opposite the applicator roll coated with charged particles the toner is selectively transferred to the electrostatic images on the surface of the dielectric cylinder. The non-imaged surface of the dielectric cylinder may be positively biased to prevent unwanted transfer of toner.

A scraper blade 30 is positioned against the applicator roll after toner transfer to remove any residual toner.

EXAMPLE 1

Black, non-conductive, non-magnetic toners are particularly suited to fluidized toning. The toner was stored in the reservoir and an air pressure of approximately 2 lbs/(inch)$^2$ is maintained in the air cylinder to insure a steady air flow of approximately 1 standard cubic foot/hour/(inch)$^2$. A porous plate such as those supplied by Chromex with a 5 micron pore size was used to control the flow of air through the reservoir. A device for vibrating the system was attached to the porous plate in such a way as to avoid obstruction of the air flow. A corona wire placed horizontally across the reservoir, within the fluidized bed of toner, and parallel to the applicator roll is shown in FIG. 3. A voltage of 7 Kilovolts was placed across the corona wire generating a visible black cloud of positively charged toner particles in the space above the fluidized bed. The applicator roll was positively biased at 210 volts and rotated at a speed of 1 inches/second. The positively biased applicator roll insured the retention of negatively charged particles. The dielectric cylinder and the paper web were run at matching speeds. The applicator roll spacing with the dielectric cylinder was 0.007 inches. This spacing may be varied depending upon the toner used, the biasing voltages, and the printing speed.

The dielectric cylinder was positively biased at 290 volts. The ion generator selectively erases the dielectric cylinder bias by depositing negatively charged ions on the surface of the dielectric in the form of images to be printed. The screen electrode voltage of the ion generating printhead is in the range of 600–700 volts. Thus toning was accomplished by a 210 volt forward bias on the applicator roll in addition to the negatively charged latent image. The non-toned surface of the dielectric cylinder retains an 80 volt reverse bias relative to the applicator roll.

Residual toner on the applicator was transferred back to the reservoir by a flexible mylar blade which scrapes the toner from the applicator surface. An overflow drain was provided in the wall of the reservoir to maintain a constant height of the fluidized bed.

EXAMPLE 2

Figure 4:
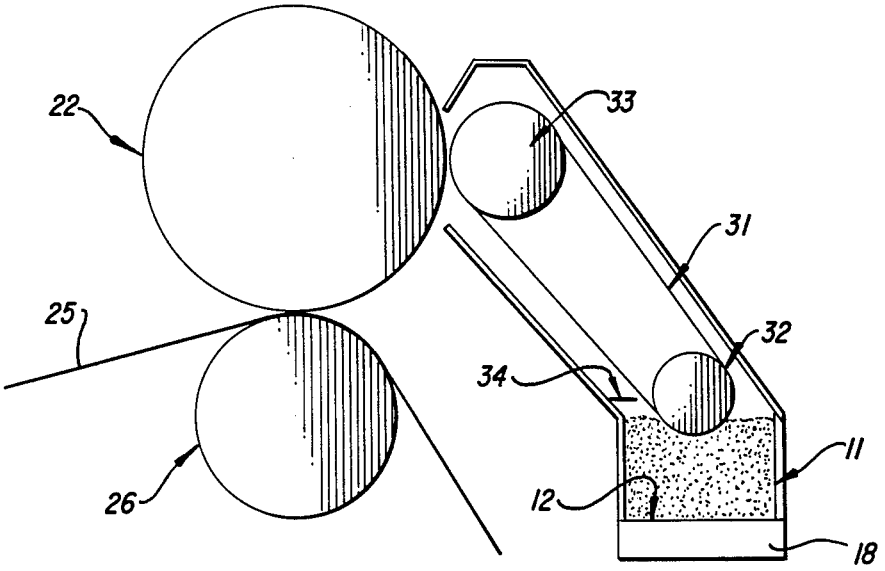
FIG. 4 is a schematic view of another fluidized bed delivery system.

An embodiment is illustrated in FIG. 4 where a continuous belt 31 is used to deliver toner to the surface of the dielectric cylinder 22. The belt is immersed directly into the fluidized bed so as not to depend on charged toner formation to come into contact with the charged toner particles. This generates an even distribution of toner on the belt which is grounded. The charge on the toner is not depleted by contact with the grounded belt as the toner also acts as an insulator. The dielectric cylinder is negatively charged by the printhead in the form of images to be printed. The positively charged toner particles are transfered onto these electrostatic images when the belt brings the toner into a position opposite the dielectric cylinder. The cylinder then fuses the toner onto paper 25.

What is claimed is:

1. A method of applying toner to a member comprising:

storing toner particles;

producing a fluidized bed of the stored toner by using a gaseous stream;

charging the fluidized toner particles; and transferring the charged particles to a dielectric member by immersing a toner receptive material in the fluidized bed;

coating said receptive material with charged particles from said fluidized toner; and conveying charged particles on said receptive material onto electrostatically defined images on the dielectric member.

2. A method as defined in claim 1 wherein said storing step is followed by the further step of vibrating the toner.

3. A method of applying toner to a member comprising:

storing toner particles;

fluidizing the stored toner by using a gaseous stream;

charging the fluidized toner particles; and transferring the charged particles to a dielectric member by forming a cloud of charged toner paticles in contact with a toner receptive materially;

coating said receptive material with charged particles from said cloud; and conveying charged particles on said receptive material onto electrostatically defined images on the dielectric member.

4. An electrostatic toning method comprising:

means for storing toner particles;

means for fluidizing the toner particles;

means for charging the toner particles; and means for conveying the charged toner particles to a dielectric member;

wherein said fluidizing of the toner particles promotes the transfer of the particles to said dielectric member;

wherein said conveying means comprises a toner receptive material that is coated by the charged toner particles; and means for delivering the charged toner particles on the surface of the receptive material onto electrostatic images on the dielectric member.

5. An electrostatic toning apparatus as defined in claim 4 wherein said charging means comprises a corona discharge.

6. An electrostatic toning apparatus as defined in claim 4 wherein said fluidizing means comprises a gaseous stream.

7. An electrostatic toning apparatus as defined in claim 4 wherein said toner particles have reduced magnetism.

8. An electrostatic toning apparatus as defined in claim 4 wherein said toner particles have reduced conductivity.

* * * * *